US012565378B2

(12) United States Patent
Untch

(10) Patent No.: US 12,565,378 B2
(45) Date of Patent: Mar. 3, 2026

(54) PROTECTIVE DEVICE, PROTECTIVE ARRANGEMENT FOR A CONTAINER AND METHOD FOR CONNECTING A PROTECTIVE DEVICE TO A CONTAINER

(71) Applicant: U-CONSULTING GmbH, Wolfertschwenden (DE)

(72) Inventor: Günter Untch, Badenweiler (DE)

(73) Assignee: U-CONSULTING GmbH, Wolfertschwenden (DE)

( * ) Notice: Subject to any disclaimer, the term of this patent is extended or adjusted under 35 U.S.C. 154(b) by 34 days.

(21) Appl. No.: 18/577,290

(22) PCT Filed: Jun. 10, 2022

(86) PCT No.: PCT/EP2022/065845
§ 371 (c)(1),
(2) Date: Jan. 8, 2024

(87) PCT Pub. No.: WO2023/280509
PCT Pub. Date: Jan. 12, 2023

(65) Prior Publication Data

US 2024/0246754 A1 Jul. 25, 2024

(30) Foreign Application Priority Data

Jul. 8, 2021 (DE) ..... 10 2021 117 729.4

(51) Int. Cl.
*B65D 90/04* (2006.01)
*B65D 88/30* (2006.01)

(52) U.S. Cl.
CPC ..... *B65D 90/046* (2013.01); *B65D 88/30* (2013.01); *B65D 2590/046* (2013.01)

(58) Field of Classification Search
CPC ..... B65D 88/1618; B65D 88/1668; B65D 88/1612; B65D 77/065; B65D 77/068;
(Continued)

(56) References Cited

U.S. PATENT DOCUMENTS 3,028,895 A * 4/1962 Gooding ..... B65D 88/1668 383/906
4,518,106 A * 5/1985 LaFleur ..... B65D 88/1668 222/105

(Continued)

FOREIGN PATENT DOCUMENTS

DE 1781146 9/1970
DE 69802935 8/2002

(Continued)

OTHER PUBLICATIONS

Translation of EP0190757 (Year: 1986).*

(Continued)

*Primary Examiner* — Don M Anderson

(57) ABSTRACT

The present invention relates to a protective device (14) for a container (12) for receiving substances, in particular pulverulent substances, wherein the protective device (14) has a flexible casing (32), which encloses a casing space (38) and comprises a first casing opening (34), and a first tubular body (40) which is connected to the casing (32) in the region of the first casing opening (34) and which has a first mating container connection unit (46), a primary first end (42) and a primary second end (44), wherein the first tubular body (40) is connected to the casing (32) in such a way that the primary first end (42) terminates with the first casing opening (34) or projects into the casing space (38), and the protective device (14) can be connected to the first container connection unit (24) by means of the first mating container connection unit (46) in such a way that the casing (32) can be introduced into the interior (18). The invention further relates to a protective arrangement (10) comprising such a container and such a protective device (14).

10 Claims, 9 Drawing Sheets

(58) Field of Classification Search
CPC ..... B65D 2590/043; B65D 2590/046; B65D 88/30; B65D 90/046; B65D 90/047
See application file for complete search history.

(56) References Cited

U.S. PATENT DOCUMENTS

| | | | | | |
|---|---|---|---|---|---|
| 4,996,760 | A * | 3/1991 | Coleman | B65D 77/068 | 383/41 |
| 5,255,492 | A * | 10/1993 | Larson | B65D 39/084 | 53/469 |
| 5,762,421 | A * | 6/1998 | Ross | B65D 88/1618 | 383/111 |
| 5,851,072 | A * | 12/1998 | LaFleur | B65D 77/065 | 383/41 |
| 5,931,205 | A * | 8/1999 | Jasica | B65B 1/04 | 141/286 |
| 6,286,700 | B1 * | 9/2001 | Davidson | B65D 77/065 | 220/1.6 |
| 2007/0237433 | A1 * | 10/2007 | Plunkett | B32B 7/05 | 383/105 |
| 2008/0006636 | A1 * | 1/2008 | Wild | B65D 77/061 | 220/9.1 |
| 2019/0168958 | A1 * | 6/2019 | Weissbrod | B65D 88/1618 | |

FOREIGN PATENT DOCUMENTS

| | | |
|---|---|---|
| EP | 0190757 | 8/1986 |
| EP | 1719714 | 11/2006 |
| WO | WO 99/03752 | 1/1999 |
| WO | WO 2005/095155 | 10/2005 |
| WO | WO 2023/280509 | 1/2023 |

OTHER PUBLICATIONS

Internationaler Recherchenbericht und Schriftlicher Bescheid [International Search Report and the Written Opinion] Dated Sep. 27, 2022 From the International Searching Authority Re. Application No. PCT/EP2022/065845 and Its Translation of Search Report Into English. (13 Pages).

* cited by examiner

A

B

PROTECTIVE DEVICE, PROTECTIVE ARRANGEMENT FOR A CONTAINER AND METHOD FOR CONNECTING A PROTECTIVE DEVICE TO A CONTAINER

RELATED APPLICATIONS

This application is a National Phase of PCT Patent Application No. PCT/EP2022/065845 having International filing date of Jun. 10, 2022, which claims the benefit of priority of Germany Patent Application No. 10 2021 117 729.4 filed on Jul. 8, 2021. The contents of the above applications are all incorporated by reference as if fully set forth herein in their entirety.

FIELD AND BACKGROUND OF THE INVENTION

The present invention relates to a protective device for a container for receiving substances, in particular for receiving pulverulent substances. The invention further relates to a protective arrangement comprising such a container and such a protective device.

Such containers have a wall that surrounds an inner space that is accessible via a container opening. Such containers are used, for example, for the storage and transporting of substances, in particular of substances that are used for chemical reactions. Such containers are additionally used to mix two or more substances. In many cases, such substances are toxic substances that have to be treated in accordance with the so-called OEB 5 or OEB 6 standard ("Occupational Exposure Band"). In accordance with the OEB 5 standard, the concentration of a specific substance may amount to a maximum of 1 $\mu g/m^3$ and to a maximum of 200 $ng/m^3$ in the OEB 6 standard.

Once such a container has been filled with a substance, the container opening is closed by a cover and this substance is transported to a location where the reactor into which the substance is transferred is located. To move it, the container is frequently clamped into a frame that is travelable. As soon as the container is in the vicinity of the reactor, the container opening is opened, and the container is connected to the reactor so that the substance can be transferred into the reactor.

The container received in the rack is frequently rotated for this purpose so that the container opening faces downward to use gravity in the emptying. Once the container is completely empty, it is closed again and can subsequently be filled with a further substance.

If, however, the substance has high toxicity, the following special conditions must be observed: As mentioned, it must be ensured that only the maximum amount of the substance can escape into the environment. As a result, the opening of the container and the connecting to the reactor must take place within an isolator, for which purpose a corresponding apparatus effort and time effort are required. Residues of the substance furthermore remain in the container, for example due to adhesive forces. It can therefore not be precluded that too high an amount of the substance can escape into the environment on a further filling. In addition, residues of the substance can result in cross-contaminations when the container is to be filled with a different substance. For safety reasons, the container is therefore cleaned after emptying and a check is subsequently made of the amounts in which the substance is still present in the container. Only when the detectable amounts are small enough can the container again be used in the manner described above. A certain time elapses in which the container is not used and takes up space until the check is complete. Such containers can consequently in particular not be managed economically when toxic substances are stored and transported in them.

SUMMARY OF THE INVENTION

It is the object of an embodiment and/or of an aspect of the present invention to provide a protective device and a protective arrangement by which it is possible with simple and inexpensive means to be able to manage a container of the type described above more economically and to simplify its handling without making any compromises in operational safety.

This object is achieved by the features specified in claim 1. Advantageous embodiments are the subject of the dependent claims.

An embodiment of the invention relates to a protective device for a container for receiving substances, in particular pulverulent substances, wherein the container

- has a wall that surrounds an inner space and has a first container opening through which the inner space is accessible; and
- comprises a first container connector unit that surrounds the first container opening and by which a connector member is connectable to the container; and
- the protective device
  - comprises a flexible casing that surrounds a casing space and comprises a first casing opening; and
  - has a first tubular member connected to the casing in the region of the first casing opening and having a first container counter-connector unit, a primary first end, and a primary second end, wherein
- the first tubular member is connected to the casing such that the primary first end terminates with the first casing opening or projects into the casing space, and
- the protective device is connectable to the first container connector unit by means of the first container counter-connector unit such that the casing can be introduced into the inner space.

The flexible casing can here comprise a plastic film, for example polyethylene or the like, that is adapted to the shape of the wall. The casing is introduced into the inner space of the container through the first container opening and is connected to the first container connector unit by the first container counter-connector unit. The substance is introduced into the casing through the primary second end and through the first tubular member. The inner space of the container can be used almost completely for the reception of the substance due to the fact that the flexible casing is adapted to the shape of the wall. The flexible casing contacts the wall in the filled state. The tubular member can be closed at the primary second end once the flexible casing has been filled with the substance. The container can now be stored and transported together with the protective device and the substance received therein. The tubular member is connected to the reactor at the primary second end for the transfer of the substance into the reactor and the substance is transferred into the reactor substantially in the already described manner. Once the flexible casing has been completely emptied, the protective device is closed at the primary second end and is separated from the container and can be disposed of, for example by incineration.

Due to the fact that the protective device prevents any direct contact between the substance and the container, no residues of the substance remain in the container after the removal of the protective device. A cleaning of the container can be dispensed with so that the container can directly subsequently be connected in the above-described manner to a further protective device and can be filled again. A laborious cleaning and a wait for the results of the check can be dispensed with so that the container can be managed considerably more economically using the protective device than is the case without using the protective device.

The first tubular member inter alia takes over the function of an adapter since the first container counter-connector unit is complementary to the container connector unit, while the primary second end can be designed largely freely so that it can be connected to the desired connector units such as pipe lines or tube lines.

In accordance with a further embodiment, the container can comprise

- a second container opening through which the inner space is accessible; and
- a second container connector unit that surrounds the second container opening and by which a further connector member is connectable to the container.

The flexible housing of the protective device here can have

- a second housing opening, and
- a second tubular member connected to the casing in the region of the second casing opening and having a second container counter-connector unit, a secondary first end, and a secondary second end, wherein
- the second tubular member is connected to the casing such that the secondary first end terminates with the second casing opening or projects into the casing space; and
- the protective device is connectable to the second container connector unit by means of the second container counter-connector unit such that the casing can be introduced into the inner space.

The container has two container openings in this embodiment. The filling and emptying can hereby be simplified since a rotation of the container can be dispensed with and the gravity acting on the substance can nevertheless be advantageously used during emptying. In addition, the first container connector unit and the second container connector unit can have different sizes and can be designed in different manners so that the flexibility can also be increased and the handling of the container simplified here.

In accordance with a further embodiment

- the first container counter-connector unit can have a flange-like radial first extension for placing on a first locking member, and/or
- the second container counter-connector unit can have a flange-like radial second extension for placing on a second locking member.

The radial first extension serves to provide an undercut by which the first locking member and/or the second locking member can introduce a connecting force to the first or second tubular member by which the first or second tubular member can be fastened to the container. The first or second locking member can here be formed in the manner of a cap nut, of a swing top, or of a tension lock to name some examples in a non-exclusive manner. It is possible to use differently formed locking members using the first or second radial extensions. It is consequently possible to flexibly react to the respective demands that are present. The radial extension does not necessarily have to project radially over the tubular member here, but can rather, for example, be formed by a recess in which the locking member can engage. In this case, the radial extension can be understood as a radially extending section.

In a further developed embodiment,

- the first container counter-connector unit can be formed in the manner of a first tri-clamp connector; and/or
- the second container counter-connector unit can be formed as a second tri-clamp connector.

Tri-clamp connectors are in particular frequently used in pharmaceutical and biotechnological applications. The probability that an already present container has a tri-clamp connector is therefore very high. The protective device can consequently be used for such a container without adaptations having to be made. Tri-clamp couplings are standardized, for example, in ISO 2852 1993-06 (issued in June 1993 and canceled in the meantime) or in DIN 31676 in the version valid on the priority data. The two elements to be connected, typically pipe lines or tubular members, here respectively have a flange at their ends to be connected whose diameter and whose slant are fixed in the standards specified. In this case, the locking member is formed as a tri-clamp fastener that engages around the two flanges in the connected state and the elements are connected to one another. A respective groove is arranged in the touching surfaces of the flanges and an O ring seal can be placed therein to seal the pipe lines. It is possible in the present case to provide the tubular members at their corresponding ends with such flanges that can be connected to the container by the fasteners. It is, however, also possible to design the tubular members such that they are placed in the groove, that is per se intended for the O ring seal, at the corresponding ends. The second flange is then formed by a separate component. The tri-lamp fasteners can be formed, for example, by a coupling unit that is disclosed in WO 2017/046220. It is, however, also possible to design the container connections and the container counter-connector unit so that different clamping connections can be provided.

In a further developed embodiment,

- a first coupling unit can be arranged at the primary second end of the first tubular member to connect a connector member, and/or
- a second coupling unit can be arranged at the secondary second end of the second tubular member to connect a connector member.

In this embodiment, the primary second end and/or the secondary second end can, for example, be connected to a pipe line, to a tube, or the like. In the connected state, the substance can be reliably transferred into the flexible casing. An uncontrolled release of the pipe line or of the tube from the tubular member and consequently an uncontrolled escape of the substance into the environment can be prevented.

In a further developed embodiment,

- the first coupling unit can be formed in the manner of a first-tri-clamp connector; and/or
- the second coupling unit can be formed in the manner of a second tri-clamp connector.

As mentioned, tri-clamp connectors are frequently in particular used in pharmaceutical and biotechnological applications. It is possible to this extent to make use of tried and tested connectors that have good availability.

In a further embodiment,

- the connector member connected to the first coupling unit can be formed in the manner of a first containment interface; and/or
- the connector member connected to the second coupling unit can be formed in the manner of a second containment interface.

Such containment interfaces are known, for example, from patent application WO 2016/142432 A1. Such containment interfaces can be connected to correspondingly designed containment counter-interfaces. They are in particular characterized in that they can only be opened and closed in the connected state. Two closed spaces can therefore be connected to one another such that they are only open toward one another, but not to the environment. Substances can consequently be transferred into the container without there being any risk that the substance can escape into the environment during the transfer. It is simultaneously prevented that substances from the environment can move into the substance and can contaminate it. Nor does any substance remain stuck to surfaces accessible from the outside on separation. To this extent, toxic substances can also be transferred from one container to another without any risk for the substances themselves or for the environment.

In accordance with a further embodiment, the first tubular member and/or the second tubular member is/are produced from a flexible material. This design is suitable for containers that have two container openings. The protective device can also be led through the container completely with the first container counter-connector unit and the second container counter-connector unit and, depending on the design, also with the containment interfaces from one side, here through the second container opening. The protective device can subsequently be connected to the first container connector unit and to the second container connector unit. The first container connector unit and the first container counter-connector unit in particular each have two radially outwardly projecting flanges when they are formed in the manner of a first tri-clamp connection. When leading the protective arrangement through the second container opening, the first container counter-connector of the first tubular member abuts the wall of the container seen from the inner space from the inside in the region of the first container connector unit. The first container counter-connector must, however, be connected to the container connector unit from the outside for a correct connection. For this purpose, the first container counter-connector unit has to be led through the container connector unit from the inside, which is not easily possible with a rigid design of the first tubular member. In this embodiment, the first container counter-connector unit can be deformed during the leading through so that it can subsequently be connected to the container connector unit from the outside.

The protective device can in particular be manufactured in a clean room and be dispatched with closed containment interfaces when the protective device is provided with containment interfaces. The respective containment interfaces are only opened on the transfer of the substance into the casing space. The casing space contributes to the purity to this extent that has been imposed on the casing space in the clean room, Contaminations originating from the protective device can consequently be largely excluded.

An embodiment of the invention relates to a protective arrangement comprising

- a container for receiving substances, in particular pulverulent substances, having
  - a wall that surrounds an inner space and has a first container opening through which the inner space is accessible; and
  - a first container connector unit that surrounds the first container opening and by which a connector member is connectable to the container, and
- a protective device in accordance with one of the previously discussed embodiments, wherein the protective device is connected to the first container connector unit by means of the first container counter-connector unit such that the casing can be introduced into the inner space.

The technical effects and advantages that can be achieved with the protective arrangement in accordance with the proposal correspond to those that have been discussed for the present protective device for receiving of substances. It must be pointed out in summary that a laborious cleaning of the container and a subsequent check whether there are still residues of the substance in the container can be dispensed with. The container can consequently be managed more economically.

A further developed embodiment provides that

- the first container connector unit and the first container counter-connector unit are configured for a use of a first locking member; and/or
- the second container connector unit and the section container counter-connector unit are configured for a use of a second locking member.

To be able to use locking members, they must be able to introduce forces into the first and/or second tubular members and into the container. The first and/or second tubular members can, for example, have a radial first or radial second extension for this purpose that serves to provide an undercut. The undercut can, however, also be provided with recesses or hooks, for example. The first locking member and/or the second locking member can introduce a connecting force into the first or second tubular member by this undercut by which the first or second tubular member can be fastened to the container. The first or second locking member can here be formed in the manner of a cap nut, of a swing top, or of a tension lock to name some examples in a non-exclusive manner. It is possible to use very differently formed locking members using the first or second radial extension. It is consequently possible to flexibly react to the respective demands that are present.

In accordance with a further embodiment

- the first container connector unit and the first container counter-connector unit are formed in the manner of a first clamp connection and/or
- the second container connector unit and the section container counter-connector unit are formed in the manner of a second clamp connection.

Clamp connections are characterized, in particular in comparison with screw connections, in that they can be established and released again faster and more simply. An aspect of clamp connections to be emphasized is represented by tri-clamp connections. Tri-clamp connectors are in particular frequently used in pharmaceutical and biotechnological applications. The probability that an already present container has a tri-clamp connector is therefore very high. The protective device can consequently be used for such a container without adaptations having to be made.

In a further developed embodiment

- the first container connector unit can have a first inner diameter;
- the second container connector unit can have a second inner diameter; and
- the first coupling unit can have a first outer diameter,
- wherein the first outer diameter is smaller than the first inner diameter and the second inner diameter.

This design is suitable for containers that have two container openings. Typically, the first inner diameter corresponds to the diameter of the first container opening and the second inner diameter corresponds to the diameter of the second container opening. The protective device can be led through the container completely with the first container counter-connector unit and the second container counter-connector unit and, depending on the design, also with the containment interfaces from one side, here through the second container opening. The protective device can subsequently be connected to the first container connector unit and to the second container connector unit. The protective device can in particular be manufactured in a clean room and be dispatched with closed containment interfaces when the protective device is provided with containment interfaces. The respective containment interfaces are only opened on the transfer of the substance into the casing space. The casing space contributes to the purity to this extent that has been imposed on the casing space in the clean room, Contaminations originating from the protective device can be largely excluded. The requirement for this is that the maximum outer diameter of the first containment interfaces does not exceed the first outer diameter.

In accordance with a further embodiment, the container has a connector that opens into the inner space and by which a fluid communication can be established with the space between the wall and the casing. A vacuum pump can be connected to the connector to generate a negative pressure or a vacuum between the wall and the casing. As a result, the casing is drawn toward the wall of the container. The connector can comprise a closure element by which the once generated negative pressure or the once generated vacuum can be maintained in that the closure element is closed. The casing remains in contact with the wall for so long until the vacuum or negative, pressure is eliminated by opening the closure element. On the one hand, the casing is drawn toward the wall, whereby the formation of folds and consequently of dead spaces is avoided. The volume of the inner space of the container is used in the best possible manner. On the other hand, the casing is fixed with respect to the wall so that an unwanted slipping and a tearing of the casing are avoided. To effectively prevent the fold formation, it appears suitable to provide more than one connector by which the fluid can be removed from the space between the wall and the casing.

Alternatively, for example, filtered air can be introduced into the casing space by means of a pump so that an excess pressure is built up in the flexible casing. A filter can be provided for this purpose through which the air is pumped into the casing space. In this case, the air that is in the space between the wall and the casing is displaced by the expanding casing through the connector into the environment of the container until the flexible casing contacts the wall. To avoid a folding up of the flexible casing on the letting out of the excess pressure, the closure element can be closed before the letting out. The flexible casing can then be filled and emptied at atmospheric pressure or even at a small negative pressure.

An implementation of the present invention relates to a method of connecting a protective device in accordance with one of the previously discussed embodiments having a container, wherein the container has a wall that surrounds an inner space and has a first container opening through which the inner space is accessible, and comprises a first container connector unit that surrounds the first container opening and by which a connector member is connectable to the container. The method comprises the following steps here:

- introducing the protective device into the inner space through the first container opening; and
- connecting the protective device to the first container connector unit by means of the first container counter-connector unit.

In the connected state, the already described protective arrangement is provided in which the flexible casing is fastened to the container. The advantages and technical effects that can be achieved with the method correspond to those that have been described for the protective device and for the protective arrangement. It should in particular be pointed out at this point that a cleaning of the container after the removal of the flexible casing can be dispensed with since the substance that can be introduced into the casing space does not come into contact with the container.

In accordance with a further implementation in which the container has a connector that opens into the inner space and by which a fluid communication can be established with the space between the wall and the casing, the method comprises the following steps:

- applying a negative pressure in the space between the wall and the casing using the connector.

The casing is drawn toward the inner surface of the wall of the container as a result of the negative pressure and is fixed there. The volume of the inner space of the container and of the casing space are then largely the same. It is ensured, on the one hand, here that the volume of the container can be used almost completely. It is ensured, on the other hand, that the flexible casing is fixed in the container so that it does not slip in operation. It is even possible to apply a negative pressure in the casing space as long as it is smaller than the negative pressure between the wall and the casing. The filling and emptying of the casing space with the substance can be simplified due to the negative pressure in the casing space.

As mentioned, the flexible casing is drawn to the inner surface of the wall of the container on the application of a negative pressure. The flexible casing consequently expands. Air must be able to flow into the casing space so that this expansion is possible. For this purpose, at least one venting unit can be provided that can be flowed through by the air that flows into the expanding casing. A filter can be arranged in the venting unit to filter the air that flows through so that the casing space remains sterile.

In accordance with a further implementation in which the container has a connector that opens into the inner space and by which a fluid communication can be established with the space between the wall and the casing, the method comprises the following steps:

- applying an excess pressure in the casing space using the first tubular member, and
- draining off the fluid that is in the space between the wall and the casing through the connector.

In this implementation, a fluid, in particular air, can be introduced into the casing space, whereby the flexible casing is pressed toward the inner wall of the container. The shape of the flexible casing again adapts itself to that of the inner space so that the latter can be used almost completely. When the flexible casing expands, the fluid, typically air, that is in the space between the wall and the casing is drained off through the connector. In the event that the casing space has to remain sterile, the air can be conducted through corresponding filters. As already mentioned, a closure element can be arranged downstream. Once the fluid has been introduced into the casing space and the flexible casing has placed itself against the inner surface of the wall, the closure element can be closed. The flexible casing also remains at the wall when the excess pressure in the casing space is let off. The flexible casing is also fixed in the container in this case. It is additionally possible in this case to apply a certain negative pressure in the casing space, whereby the above-named advantages can be provided in the filling and emptying of the flexible casing.

BRIEF DESCRIPTION OF THE SEVERAL VIEWS OF THE DRAWINGS

Exemplary embodiments of the invention will be explained in more detail in the following with reference to the enclosed drawings. There are shown FIG. 1 a basic sectional representation through a first embodiment of a protective arrangement in accordance with the invention.

DESCRIPTION OF SPECIFIC EMBODIMENTS OF THE INVENTION

Figure 1:
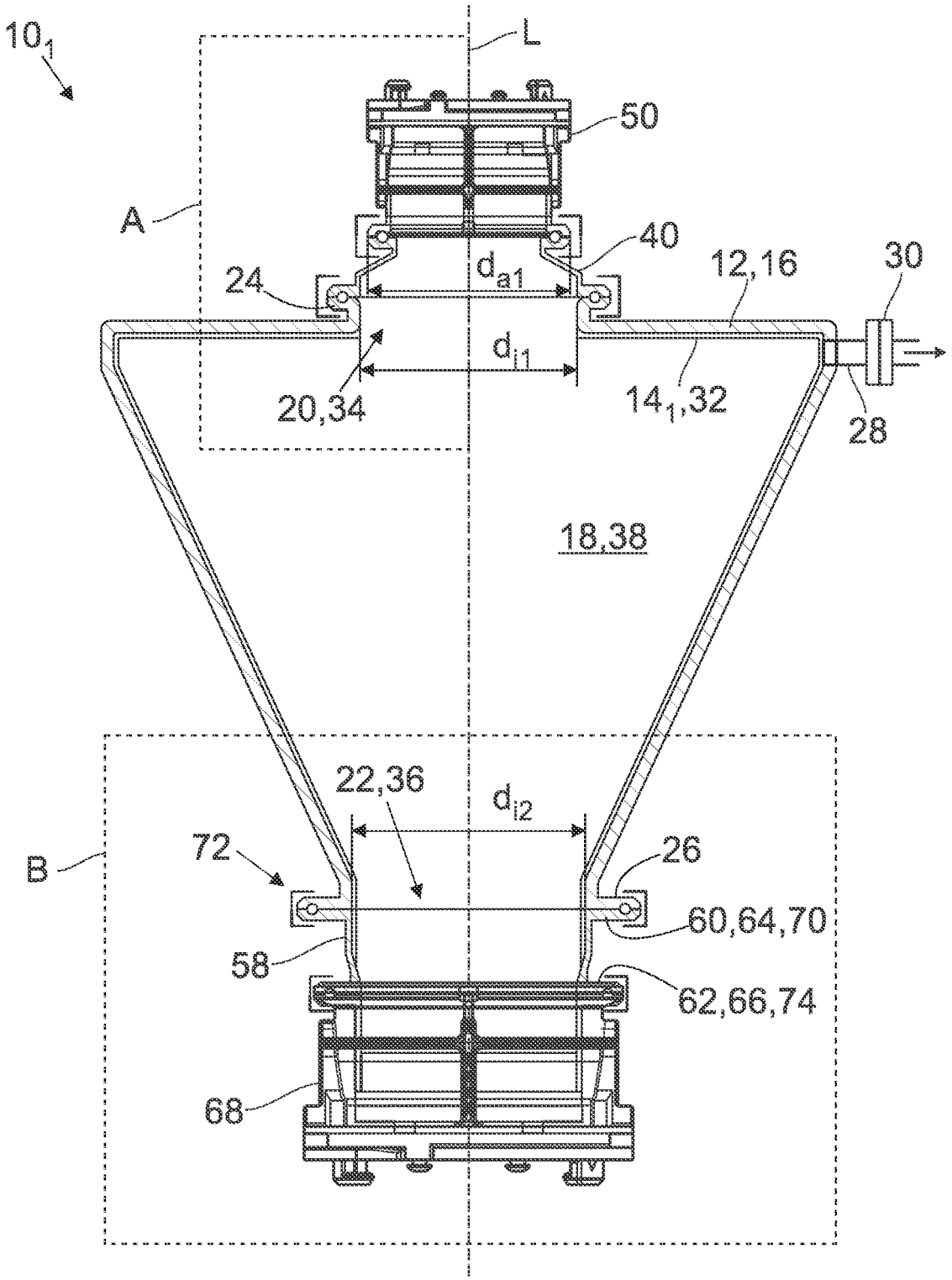

A basic sectional representation through a first embodiment of a protective arrangement $\mathbf{10}_1$ in accordance with the invention is shown in FIG. 1. The regions A and B defined in FIG. 1 are not to scale and are shown purely basically enlarged in FIGS. 2 and 3. The protective arrangement $\mathbf{10}_1$ comprises a container 12 and a protective device $\mathbf{14}_1$, the latter in accordance with a first embodiment.

The container 12 has a wall 16 that surrounds an inner space 18. In the embodiment shown, the container 12 is equipped with a first container opening 20 and an oppositely disposed second container opening 22 that each have a circular cross-section and are arranged concentrically with respect to a longitudinal axis L defined by the container 12. The inner space 18 is accessible through the first container opening 20 and the second container opening 22. The first container opening 20 is surrounded by a first container connector unit 24 and the second container opening 22 is surrounded by a second container connector unit 26. A first connector member can be fastened to the first container connector unit 24 and a second connector member can be fastened to the second container connector unit 26, which will be looked at in more detail below. The container 12 furthermore comprises a connector 28 that penetrates the wall 16 and is thus in communication with the inner space 18. The connector 28 can be selectively opened and closed by a closure element 30.

As mentioned, the protective arrangement $\mathbf{10}_1$ furthermore comprises the protective device $\mathbf{14}_1$ that has a flexible casing 32. The flexible casing 32 is provided with a first casing opening 34 and with a second casing opening 36 that are each in communication with a casing space 38 that is surrounded by the flexible casing 32.

A first tubular member 40 that comprises a primary first end 42 and a primary second end 44 (see in particular FIG. 2) is arranged in the region of the first casing opening 34. The first tubular member 40 is connected to the flexible casing 32 in a gastight manner in the region of the primary first end 42 (see FIG. 2). In the embodiment shown, the primary first end 42 is designed such that the first tubular member 40 projects a little into the casing space 38. It is, however, equally well possible to design the primary first end 42 such that the primary first end 42 terminates with the first casing opening 34 and thus does not project into the casing space 38. As can likewise be seen from FIG. 2, the first tubular member 40 forms a first container counter-connector unit 46 in the region of the primary first end 42, said first container counter-connector unit 46 being formed such that the first tubular member 40 can be fastened to the container 12 using the first container connector unit 24. To this extent, the above-mentioned first connector member in the embodiment shown is formed as the first tubular member 40.

The first tubular member 40 forms the first coupling unit 48, by which a further first connector member can be fastened to the first tubular member 40, at the primary second end 44. In the first embodiment shown, the further first connector member is designed in the manner of a first containment interface 50. Such containment interfaces are known, for example, from WO 2016/14232 A1 and can be connected to correspondingly designed counter-interfaces that will be looked at in more detail below (see FIG. 8).

The first container counter-connector unit 46 can be formed in the manner of a first tri-clamp connector 52. The first container connector unit 24 is formed as complementary to the first container counter-connector unit 46 so that they are formed in the manner of a first tri-clamp connection 54 in the connected state. It is, however, also possible to design the first container connector unit 24 and the first container counter-connector unit 46 such that they provide a differently designed clamp connection.

The first coupling unit 48 is also formed in the manner of a first tri-clamp connector 56 so that the connection between the first tubular member 40 and the first containment interface 50 is likewise implemented by means of a tri-clamp connection. Tri-clamp couplings are standardized, for example, in ISO 2852 1993-06 (issued in June 1993 and canceled in the meantime) or in DIN 31676 in the version valid on the priority data.

Figure 2:
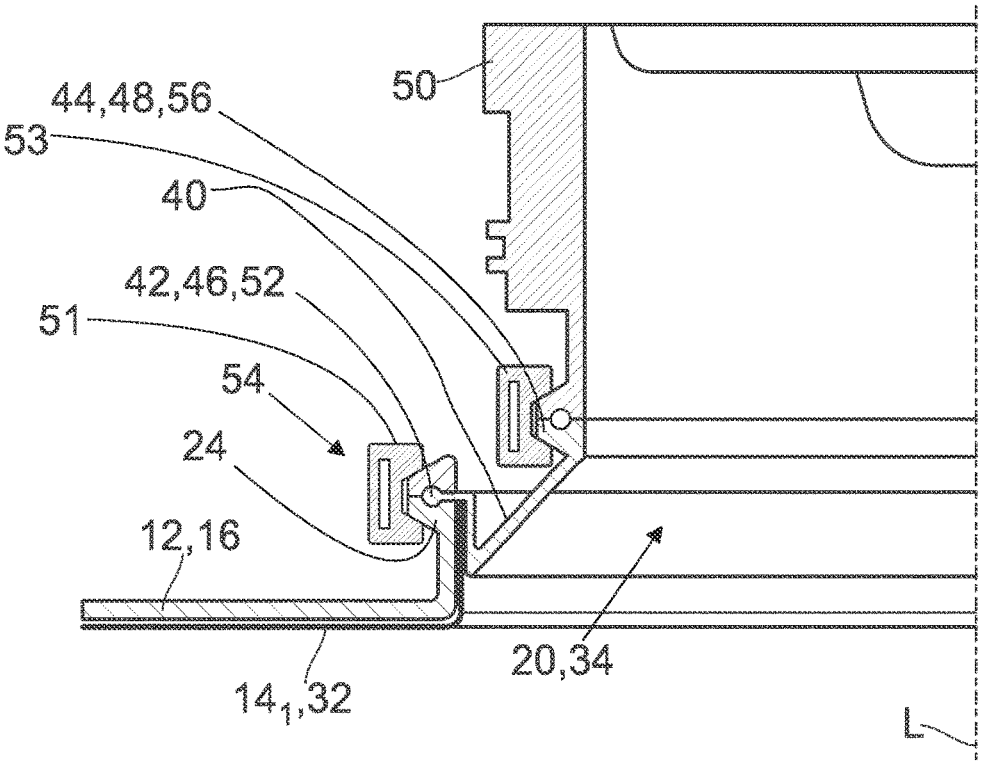
FIG. 2 a basic enlarged representation, not to scale, of the region marked A in FIG. 1.
Figure 3:
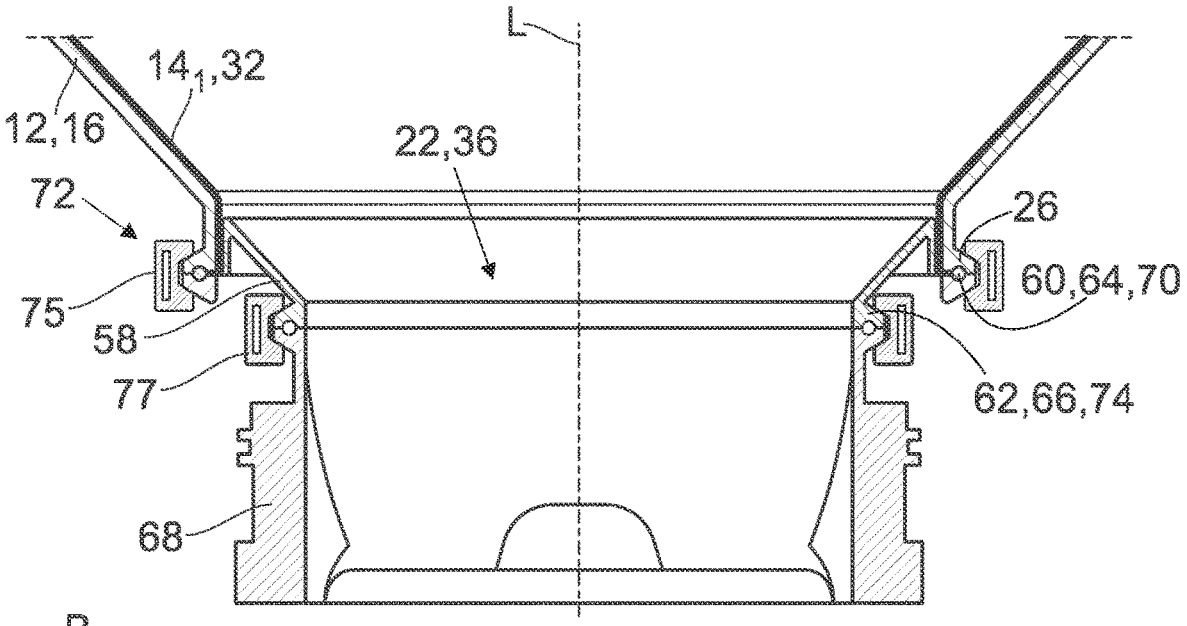
FIG. 3 a basic enlarged representation, not to scale, of the region B marked in FIG. 1.

It can be recognized from FIG. 2 that the first tubular member 40 is designed in the manner of an O ring at the primary first end 42 so that the first tubular member 40 can be placed into a groove of the tri-clamp flange of the first container connector unit 24. The second tri-clamp flange of the first tri-clamp connection 54 is formed by a separate component and likewise has a groove into which the first tubular member 40 engages at is primary first end 42. The first tubular member 40 is fastened to the container 12 in the region of its primary first end 32 by a primary first tri-clamp fastener 51.

In contrast to this, the first tubular member 40 at the primary second end 44 forms a first tri-clamp flange of the first coupling unit 48. The first containment interface 50 forms a second tri-clamp flange of the first coupling unit 48. The first tubular member 40 is fastened to the first containment interface in the region of its primary second end 44 by a secondary first tri-clamp fastener 51.

A second tubular member 58 that has a secondary first end 60 and a secondary second end 62 is arranged in the region of the second casing opening 36. The second tubular member 58 is in principle connected to the flexible casing 32 in the same manner as has been described for the first tubular member 40. The second tubular member 58 correspondingly also has a second container counter-connector unit 64 and a second coupling unit 66. The flexible casing 32 can be connected to the second container connector unit 26 of the container 12 by the second container counter-coupling unit 64. A further second connector member can be connected by the second coupling unit 66 to the second tubular member 58 that is designed as a second containment interface 68.

The second container counter-connector unit 64 is designed in the manner of a second tri-clamp connector 70, with the second container connector unit 26 being designed as complementary to the second container counter-connector unit 64. In the connected state, they form a second tri-clamp connection 72.

The second coupling unit 66 is also formed in the manner of a second tri-clamp connector 74 so that the connection between the second tubular member 58 and the second containment interface 68 is likewise implemented by means of a tri-clamp connection.

The second tubular member 58 is fastened to the container 12 in the region of its secondary first end 32 by a primary second tri-clamp fastener 75. The second tubular member 58 is furthermore fastened to the second containment interface 68 in the region of its secondary second end 62 by a secondary second tri-clamp fastener 77.

The first tubular member 40 is produced from a flexible material, with it appearing appropriate also to produce the second tubular member 58 from the same flexible material.

As can in particular be seen from FIG. 1, the first container connector unit 24 has a first inner diameter di that corresponds to the diameter of the first container opening 20. The second container connector unit 26 has a second inner diameter $d_{i2}$ that corresponds to the diameter of the second container opening 22. The first coupling unit 48 has a first outer diameter $d_{a1}$, with the first outer diameter $d_{a1}$ being smaller than the first inner diameter $d_{i1}$ and the second inner diameter $d_{i2}$. It can likewise be recognized from FIG. 1 that the largest outer diameter of the first containment interface 50 is equal to or smaller than the first outer diameter $d_{a1}$. As mentioned, the first coupling unit 48 is designed as a tri-clamp connection that comprises releasable fasteners. These fasteners are not considered in the determination of the first outer diameter $d_{a1}$.

The protective arrangement $\mathbf{10}_1$ is operated in the following manner: The flexible casing 32, the first tubular member 40, and the second tubular member 58 can be produced in a clean room and can be connected to one another there. Alternatively, they can be manufactured outside the clean room, connected to one another, and subsequently cleaned so much in a clean room as the respective application requires. The first containment interface 50 and the second containment interface 68 can likewise be connected to the first tubular member 40 or to the second tubular member 58 in the manner described above and can optionally be cleaned. The first containment interface 50 and the second containment interface 68 are in the closed state here so that the casing space 38 is hermetically sealed. The closed protective device $\mathbf{14}_1$ can subsequently be removed from the clean room and folded together such that it can be stored and transported in a space saving manner.

To introduce the protective device $\mathbf{14}_1$ into the container 12, the first containment interface 50 is led through the second container opening 22 and the inner space 18 of the container 12 until it projects a little out of the container 12 through the first container opening 20. The first containment interface 50 can now be gripped. From a certain point onward, the first container counter-connector unit 46 abuts the wall 16 of the container 12 from the inside in the region of the first container opening 20. The first tubular member 40 then projects a little out of the container 12 over the first container opening 20. As mentioned, the first tubular member 40 is produced from a flexible material. The first tubular member 40 can consequently be gripped and deformed so much that the first container counter-connector unit 46 can be led to the outside through the first container opening 20. If the first tubular member 40 is released again, the first tubular member 40 returns to its original shape again so that the first tubular member 40 can be connected to the first container connector unit 24 using the first container counter-connector unit 46.

The second container counter-connector unit 64 of the second tubular member 58 is brought into contact with the second container connector unit 26 and the second tubular member 58 is subsequently connected to the container 12.

As mentioned, the container 12 has a connector 28 that can be selectively opened or closed by a closure element 30. It is appropriate to already open the closure element 30 on the introduction of the protective device $\mathbf{14}_1$ into the container 12; however, this is not compulsory. A vacuum pump is now connected to the connector 28 and is switched on with an open closure element 30 so that the air present between the flexible casing 32 and the wall 16 of the container 12 is largely removed. Due to the negative pressure that is thus created, the flexible casing 32 is drawn toward the wall 16 so that it largely contacts the wall 16. As a result, the volume of the casing space 38 largely corresponds to that of the inner space of the container 12. The closure element 30 can now be closed and the vacuum pump can be removed from the connector 28.

Depending on the application, a first containment counter-interface, that is, for example, connected to a pipe line or to a tube line (not shown), can be connected to the first containment interface 50. The first containment interface 50 and the first containment counter-interface can now be opened and a substance, typically a pulverulent substance, can be introduced into the casing space 38. As soon as the filling has been terminated, the first containment interface 50 and the first containment counter-interface are closed and are separated from one another. The substance has in this way been transferred into the casing space 38 free of contamination without the substance having come into direct contact with the container 12. The container 12 can now be stored and transported, for example.

To empty the container 12, it can, for example, be arranged above a reactor and a connection can be established by means of a second containment counter-interface that is connected to the second containment interface 68 (not shown). The second containment interface 68 and the second containment counter-interface are now opened so that the substance flows out of the casing with the aid of gravity. A slight negative pressure can be applied by way of assistance in the casing space 38. As soon as no further substance flows out of the container 12, the second containment interface 68 and the second containment counter-interface are closed and are separated from one another. The container 12 can now be removed from the reactor. The protective device $\mathbf{14}_1$ is subsequently removed from the container 12, with a procedure being followed in reverse order in comparison with the above-described introduction and connection. It must be noted that the closure element 30 has to be open. Alternatively, one of the tubular members 40, 58 could also be released from the container 12 by so much that air from the environment can flow into the container 12. The protective device $\mathbf{14}_1$ can now be disposed of, in particular by incineration, together with the first tubular member 40, the first containment interface 50, the second tubular member 58, and the second containment interface 68. Due to the fact that the container 12 did not have any direct contact with the substance, the container 12 is immediately available for a repeat use in the above-described manner. A laborious cleaning such as is the case with conventional containers can be avoided. A different substance can in particular be introduced into the protective device $\mathbf{14}_1$ in the next application without there being any risk of cross-contamination.

Alternatively, it is also possible to proceed as follows: Instead of applying a negative pressure in the space between the flexible casing 32 and the wall 16 of the container 12, an excess pressure can be generated in the casing space 38, in particular by blowing air into the casing space 38. A filter can be arranged for this purpose such that the air has to flow through it before entering into the casing space 38. Contaminants, in particular particulates, are hereby retained. The casing space 38 can thus be kept clean and contaminations can be avoided. The closure element 30 is open here so that the air that is located in the space between the flexible casing 32 and the wall 16 can escape from the inner space 18. The flexible casing 32 that expands due to the excess pressure lies at the wall 16 from the inside and consequently almost adopts the shape of the inner space 18. The closure element 30 is subsequently closed. If the excess pressure in the casing space 38 is let out, for example to introduce a substance into it, the flexible casing 32 remains in contact with the wall 16, however. It is even possible to apply a small negative pressure in the casing space 38 without the flexible casing 32 collapsing. To remove the protective device $\mathbf{14}_1$, the closure element 30 is opened so that air from the environment can flow into the inner space 18. The $\mathbf{14}_1$ can now be removed from the container 12.

Figure 8:
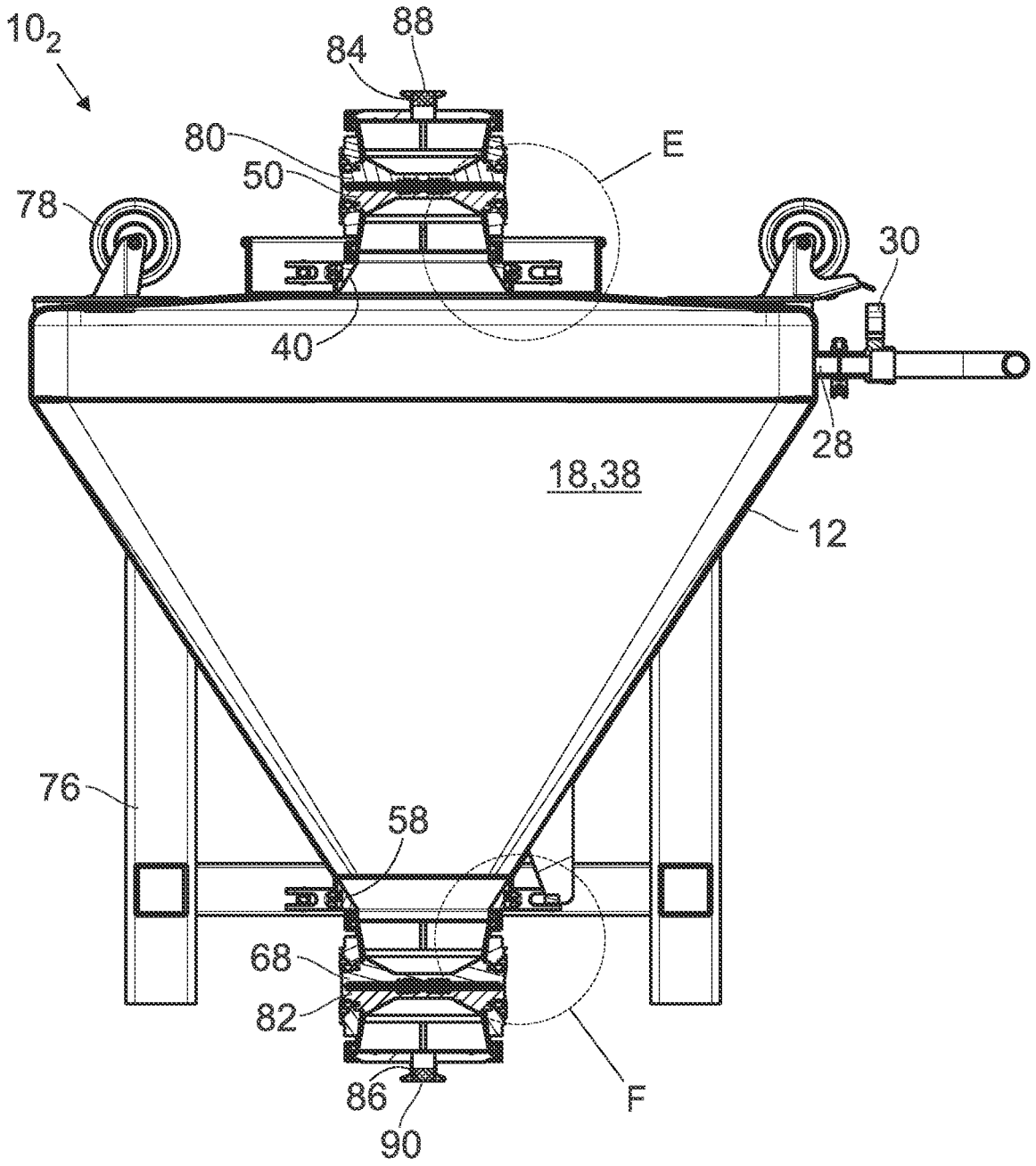
FIG. 8 the second embodiment of the protective arrangement shown in FIG. 7 in a second state.

In the event that the casing space 38 is to remain sterile, a first containment counter-interface 80 has to be connected to the first container containment interface 50 and/or a second containment counter-interface 82 has to be connected to the second containment interface 68 before the application of a negative pressure or an excess pressure (cf. FIG. 8). At least one of the mutually connected containment interfaces and containment counter-interfaces is opened so that air can flow into the casing space 38, independently of whether the air is sucked into the casing space 38 on application of a negative pressure in the space between the flexible casing 38 and the wall 16 or is conveyed into the casing space 38 on the application of an excess pressure therein. The air flowing into the casing space 38 is filtered so that the casing space 38 remains sterile. If the excess pressure or the negative pressure is let out, the air flowing out of the casing space is likewise filtered again so that it can be prevented that residues of the substance that was received in the casing space can move into the environment.

Figure 4:
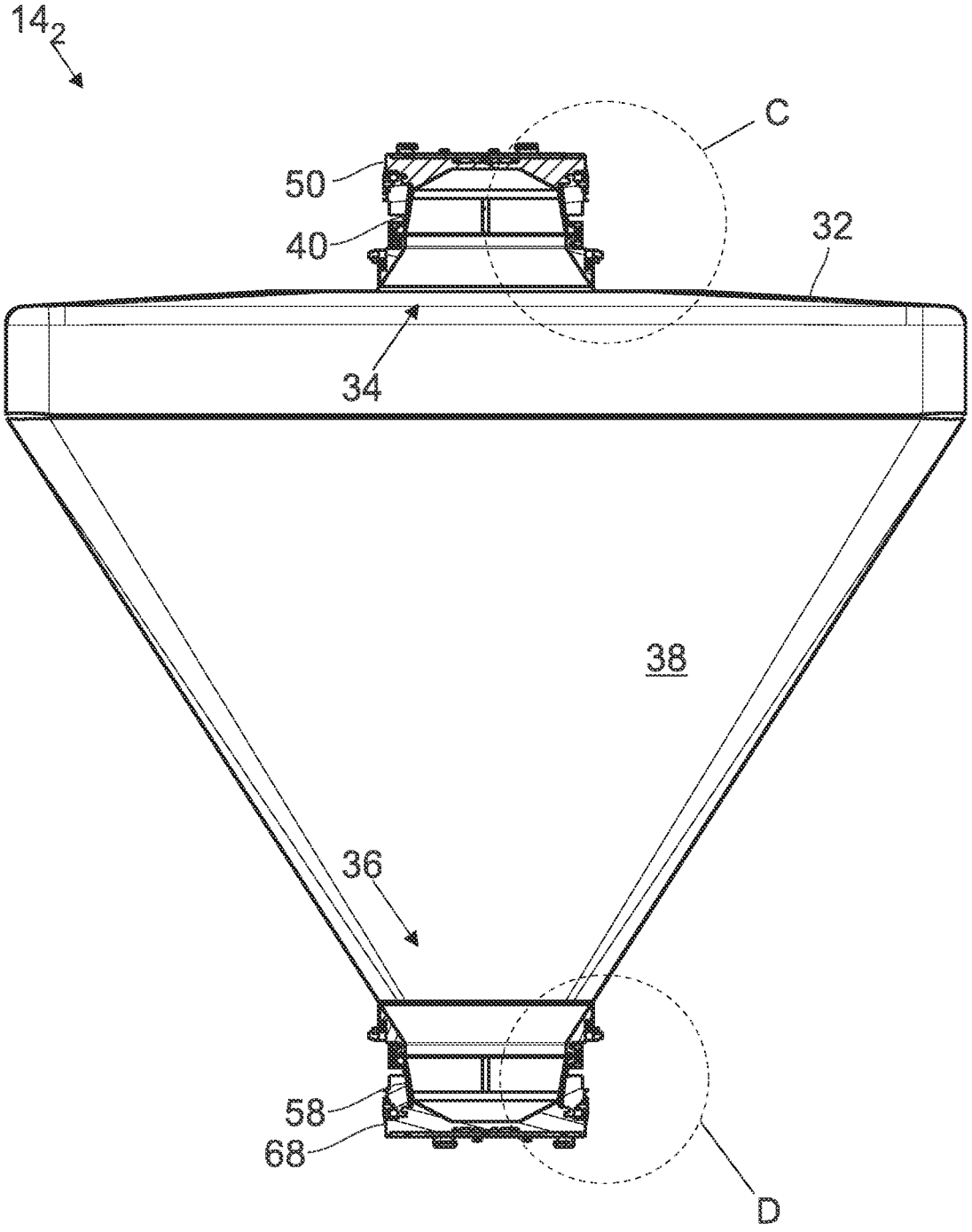
FIG. 4 a sectional representation through a second embodiment of a protective device in accordance with the invention.
Figure 5:
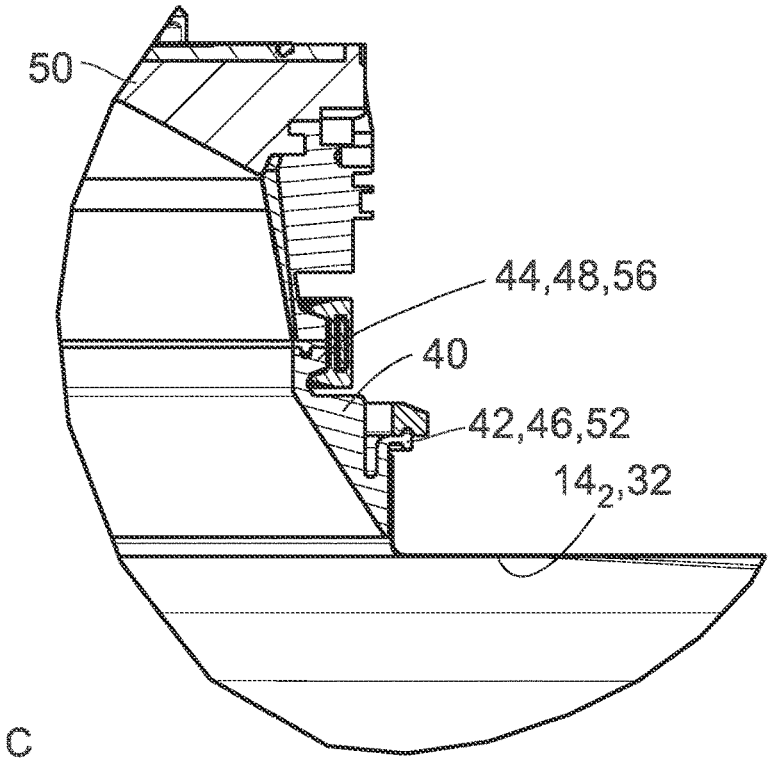
FIG. 5 an enlarged representation of the region C marked in FIG. 4.
Figure 6:
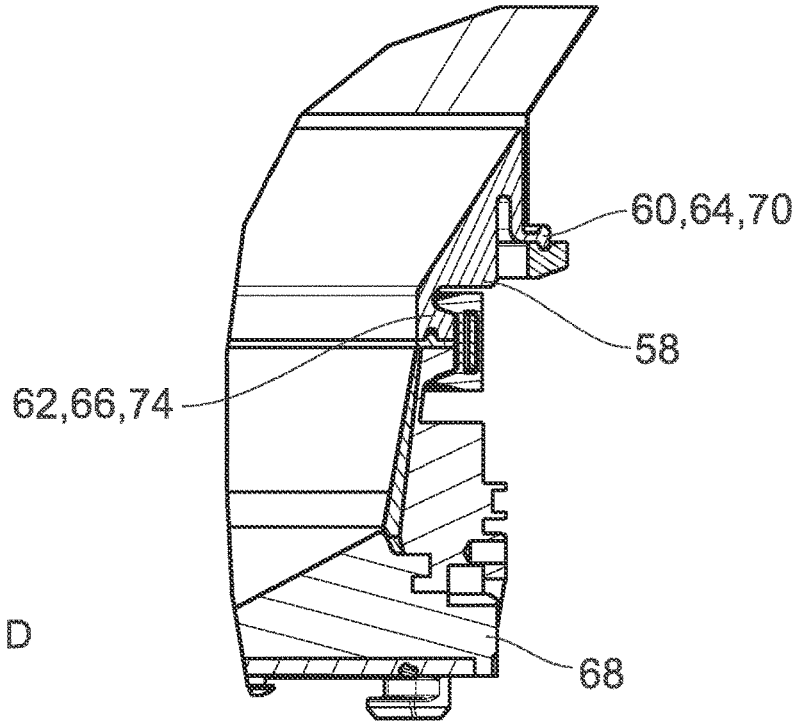
FIG. 6 a basic enlarged representation, not to scale, of the region D marked in FIG. 4.

FIG. 4 shows a sectional representation through a second embodiment of a protective device $\mathbf{14}_2$ in accordance with the invention; FIG. 5 shows an enlarged representation of the regions C marked in FIG. 4 and FIG. 6 shows a basic enlarged representation, not to scale, of the region D marked in FIG. 4. The protective device $\mathbf{14}_1$ is shown isolated from the container 12. The basic design and the manner how the protective device $\mathbf{14}_2$ is used correspond to those such as have been described for the first embodiment of the protective arrangement $\mathbf{10}_1$.

Figure 7:
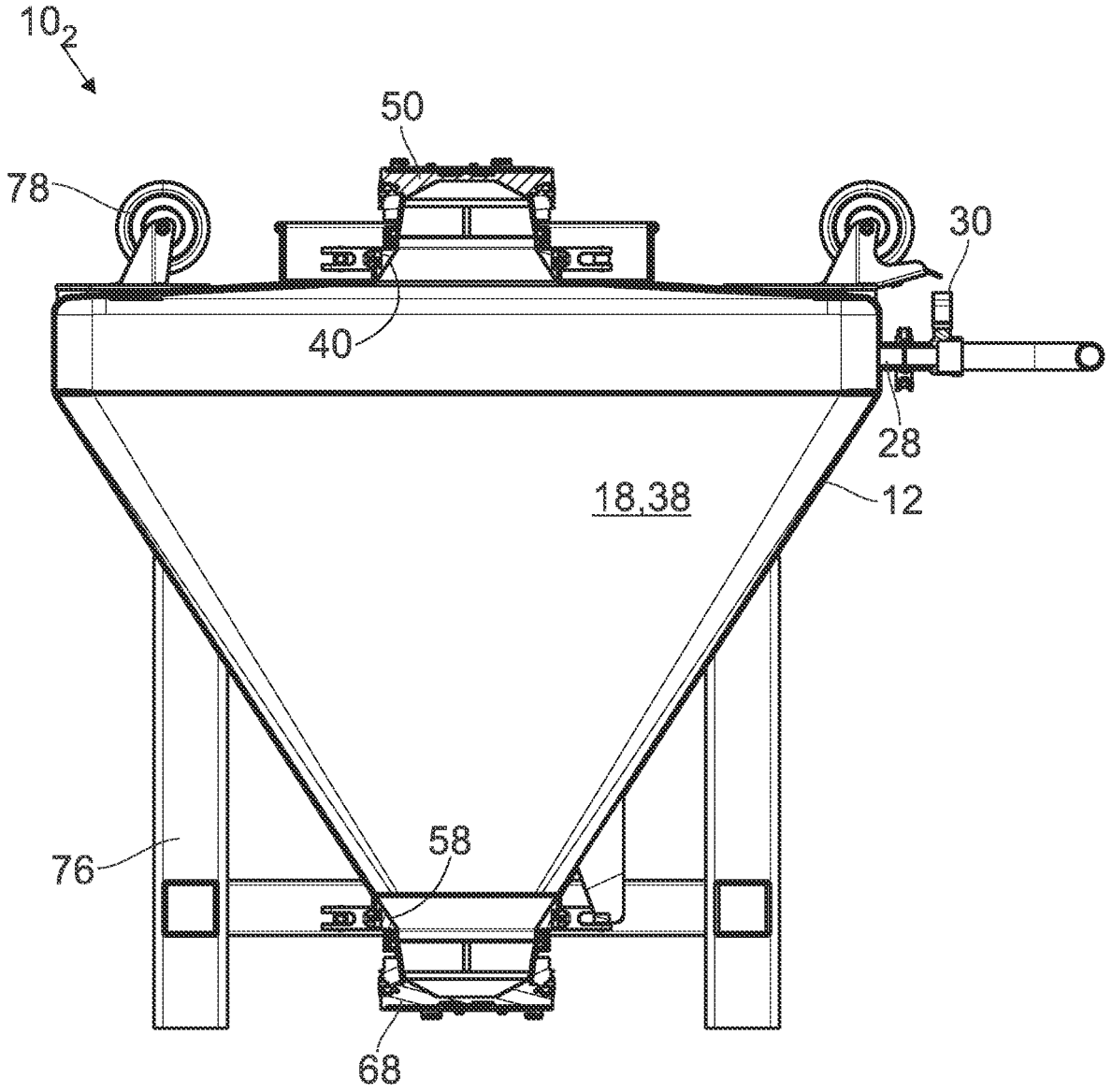
FIG. 7 a sectional representation through a second embodiment of a protective device in accordance with the invention in a first state.
Figure 9:
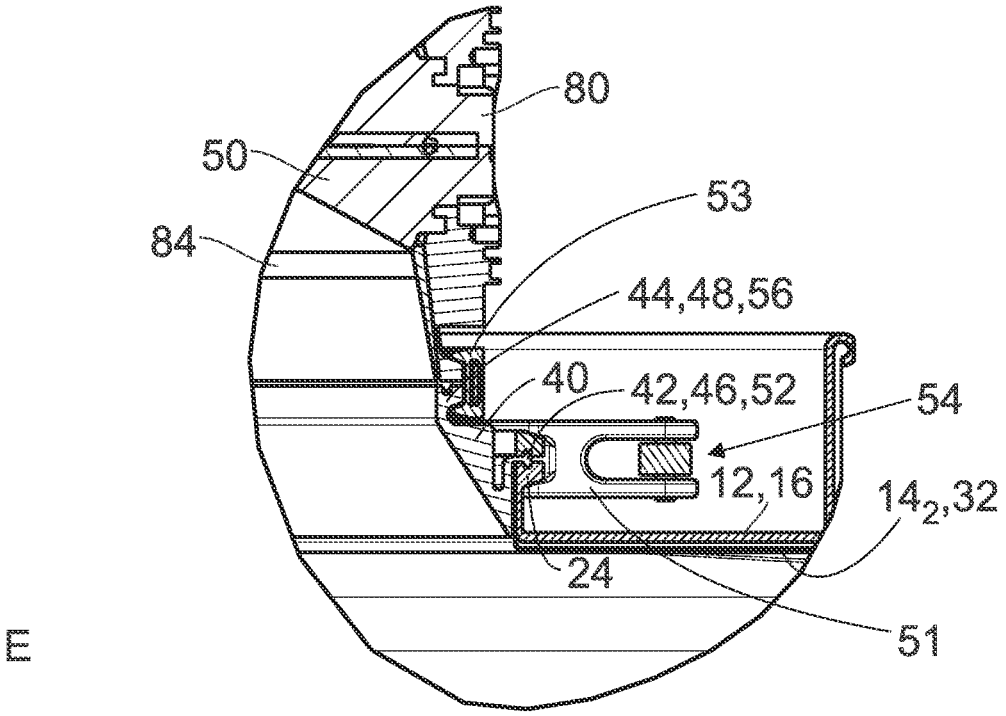
FIG. 9 an enlarged representation of the region E marked in FIG. 8.
Figure 10:
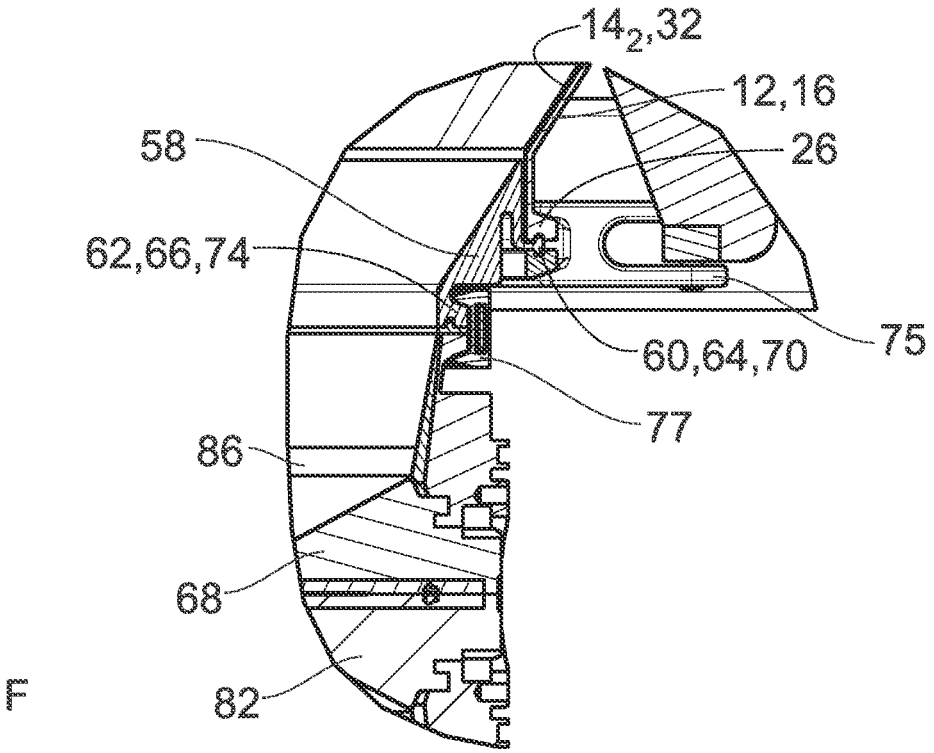
FIG. 10 a basic enlarged representation, not to scale, of the region F marked in FIG. 8.

FIG. 7 shows a sectional representation through a second embodiment of a protective arrangement 102 in accordance with the invention in a first state and in a second state in FIG. 8. FIG. 9 shows an enlarged representation of the region E marked in FIG. 8 and FIG. 10 shows a basic enlarged representation, not to scale, of the region F marked in FIG. 8. The protective device $\mathbf{14}_2$ is introduced into the container 12 in the same way here as has been described with respect to FIG. 1. As can be seen from a comparison of FIGS. 7 and 8, the first containment interface 50 is connected to a first containment counter-interface 80 and the second containment interface 68 is connected to a second containment counter-interface 82. The first containment counter-interface 80 and the second containment counter-interface 82 can be connected to a pipe line or tube line, not shown here, for example. As already mentioned, the first containment interface 50 and the first containment counter-interface 80 can be opened and closed together in the connected state so that a substance can be introduced into the casing space 38 and removed from it again free of contamination without the permissible amount of the substance that may enter into the environment being exceeded. This is also ensured on the separation of the first containment counter-interface 80 from the first containment interface 50. The same also applies to the second containment interface 68 and the second containment counter-interface 82.

A tube line, not shown, by which air can be introduced into the casing space 38 can be connected to the first containment counter-interface 80. To avoid contaminations, a first filter 84 is arranged in or at the first containment counter-interface 80 and a second filter 86 which the air has to pass through to reach the casing space 38 is arranged in or at the second containment counter-interface 82. As already mentioned, the pressure in the casing space 38 increases as a result of the air supply so that the flexible casing 32 expands and is pressed toward the inner surface of the wall 16. The closure element 30 is open here. Once the desired amount of air has been supplied, the closure element 30 is closed. The first containment counter-interface 80 has a first venting unit 88 and the second containment counter-interface 82 has a second venting unit 90. The air can be led off from the casing space 38 into the environment to, for example, be able to introduce the substance into the casing space 38 as a result of an actuation of the first venting unit 88 and/or of the second venting unit 90. The first filter 84 and the second filter 86 are arranged here such that the escaping air is filtered. The flexible casing 32 does not collapse on the letting out of the air due to the fact that the closure element 30 remains closed. A negative pressure can even be applied in the casing space 38. It should be noted at this point that the arrangement of the first filter 84 and of the second filter 86 is purely by way of example and they can also be arranged at different positions. A separate first filter 84 can, for example, be connected to the free end of the first venting unit 88. Analogously, a separate second filter can be connected to the free end of the second venting unit 90. It is at least appropriate to arrange the first filter 84 and the second filter 86 such that no residues of the substance can move into the environment with the escaping air.

It should be noted at this point that it is sufficient for the above-named purposes if only one of the venting units 88, 90 is provided. It is additionally appropriate to design the venting units 88, 90 such that they can be flowed through bidirectionally. In this case, both air flowing into the casing space 38 and air escaping from the casing space 38 are filtered independently of whether an excess pressure is generated in the casing space 38 or whether a negative pressure is generated in the space between the flexible casing 32 and the wall 16.

It must be mentioned with reference to FIG. 8 that the container 12 is fastened to a frame 76 that has a number of rollers 78. It is possible in this way to move, in particular to push, to grip with a gripping unit, to raise, and to rotate the container 12.

Figure 11:
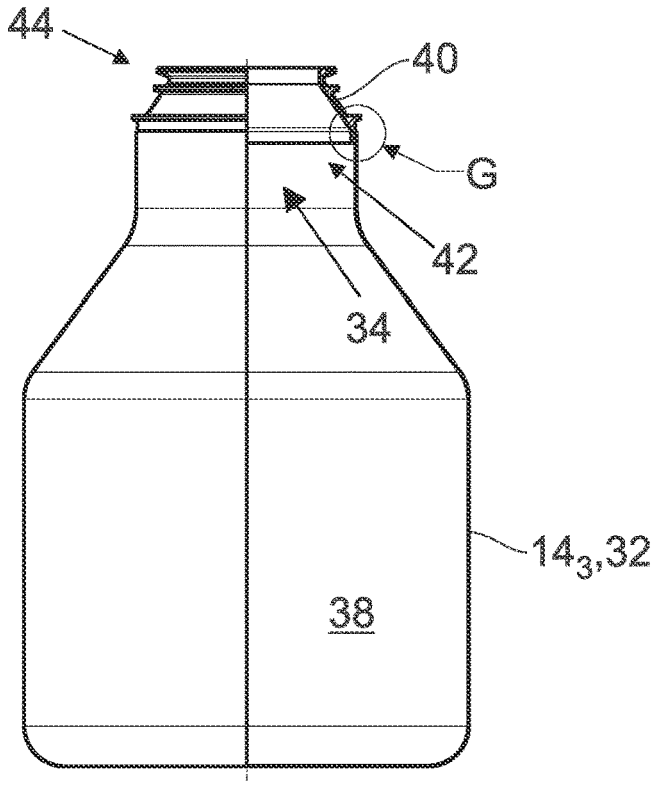
FIG. 11 a partial sectional representation through a third embodiment of a protective device in accordance with the invention.
Figure 12:
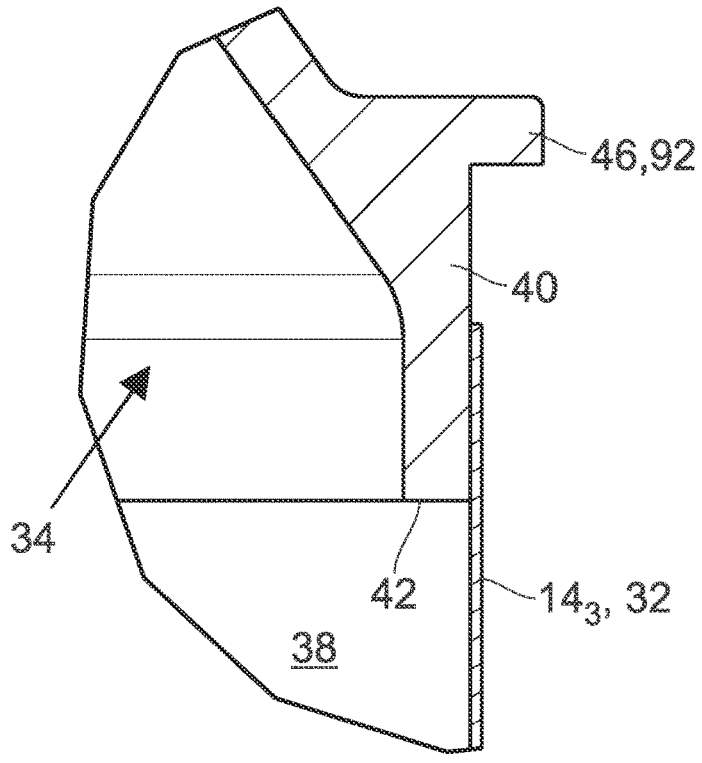
FIG. 12 an enlarged representation of the region G marked in FIG. 11.
Figure 13:
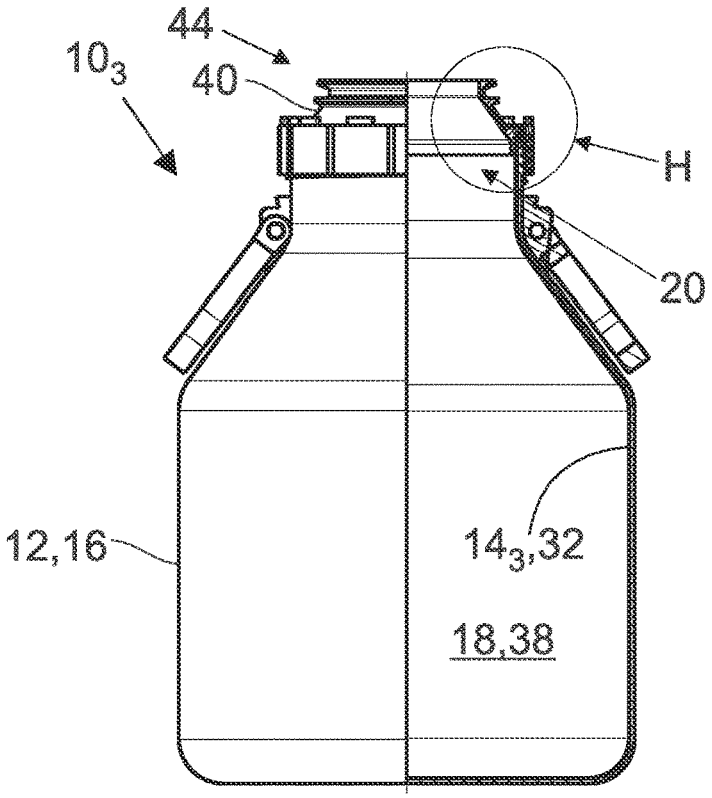
FIG. 13 a partial sectional representation through a third embodiment of a protective arrangement in accordance with the invention.

A third embodiment of a protective arrangement $\mathbf{10}_3$ in accordance with the invention, whose protective device $\mathbf{14}_3$ again has a flexible casing 32, is shown with reference to a partial sectional representation in FIG. 13. The protective device $\mathbf{14}_3$ is shown separately in FIG. 11, with FIG. 12 showing the region G marked in FIG. 11 in an enlarged representation. As already in the previously described embodiments, the flexible casing 32 is connected, for example by adhesive bonding or welding, to the first tubular member 40 in the region of the primary first end 42. In this respect, the first tubular member 40 projects, viewed starting from the first casing opening 34, a little into the flexible casing 32.

In the third embodiment, the first container counter-connector unit 46 has a flange-like radial first extension 92 on which a first locking member 94 (cf. in particular FIG. 14) can be placed. The first locking member 94 can, for example, be formed in the manner of a cap nut, of a swing top, or of a tension lock and can connect the first tubular member 40 to the container 12 using the first container connector unit 24.

Figure 14:
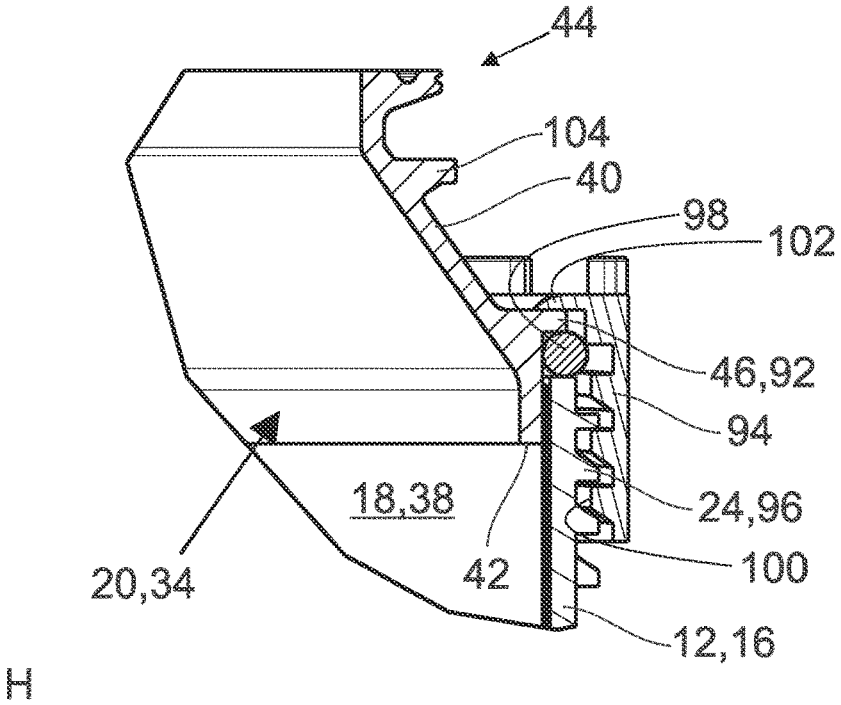
FIG. 14 an enlarged representation of the region H marked in FIG. 13.

The manner in which the first tubular member 40 is connected to the container 12 in the third embodiment of the protective arrangement $\mathbf{10}_3$ can be seen from FIGS. 13 and 14. FIG. 14 shows the region H marked in FIG. 13 in an enlarged representation.

In the shown third embodiment, the first container connector unit 24 comprises an external thread 96 onto which, for example, a screw cap, not shown here, can be screwed to close the first container opening 20. Provided that such a screw cap is screwed onto the first container connector unit 24, the screw cap is removed and the primary first end 42 of the first tubular member 40 is introduced into the first container opening 20, as shown in FIG. 14. As mentioned, the first container counter-connector unit 46 has the flange-like radial first extension 92. This radial first extension 92 also serves to pre-position a sealing member 98, an O ring here. When the first tubular member 40 is introduced into the container 12, the sealing member 98 comes into contact with the wall 16 of the container 12.

If not already done, the first locking member 94 is pushed over the first tubular member 40. The first locking member 94 has an internal thread 100 that is complementary to the external thread 96 of the first container connector unit 24. The first locking member 94 can consequently be screwed onto the first container connector unit 24. As can be seen from FIG. 14, the first locking member 94 has an L-shaped cross-section so that a radially inwardly facing limb 102 is formed. The radially inwardly facing limb 102 here projects inwardly over the internal thread 100. This limb 102 comes into contact with the radial first extension 92 due to the axial displacement of the first locking member 94 as a result of the screwing onto the first container connector unit 24, whereby a shape matching is produced. In this respect, the sealing member 98 is squeezed between the radial first extension 92 and the wall 16 so that it seals the container 12 with respect to the first tubular member 40. The container 12 can now be filled.

It can furthermore in particular be recognized in FIG. 14 that a first fastening unit 104, that can likewise be formed as a radial extension or can comprise such, is arranged between the primary first end 42 and the primary second end 44 of the first tubular member 40. A connector member, not shown here, at the first tubular member 40 or the first tubular member 40 can, for example, be connected to the container 12 by this first fastening unit 104. The radial extension can be interrupted so that a connection in the manner of a bayonet connection can be implemented. The first tubular member 40 can consequently be connected to the container 12 or to a connector member by differently designed fastening means. Additional connector members can also be connected to the tubular member, for example to form a secondary interface. The usage possibilities are hereby increased.

If the container 12 has a second container opening 22 (cf. FIG. 1), a second tubular member 58 can be connected to the container 12 in the same way (not shown). The second tubular member 58 can have a corresponding design to the first tubular member 40.

REFERENCE NUMERAL LIST

10 protective arrangement
$\mathbf{10}_1$-$\mathbf{10}_3$ protective arrangement
12 container
14 protective device
$\mathbf{14}_1$-$\mathbf{14}_3$ protective device
16 wall
18 inner space
20 first container opening
22 second container opening
24 first container connector unit
26 second container connector unit
28 connector
30 closure element
32 flexible casing
34 first casing opening
36 second casing opening
38 casing space
40 first tubular member
42 primary first end
44 primary second end
46 first container counter-connector unit
48 first coupling unit
50 first containment interface
51 primary first tri-clamp fastener
52 first tri-clamp connector
53 secondary first tri-clamp fastener
54 first tri-clamp connection
56 first tri-clamp connector
58 second tubular member
60 secondary first end
62 secondary second end
64 second container counter-connector unit
66 second coupling unit
68 second containment interface
70 second tri-clamp connector
72 second tri-clamp connection
74 second tri-clamp connector

75 primary second tri-clamp fastener
76 frame
77 secondary second tri-clamp fastener
78 rollers
80 first containment counter-interface
82 second containment counter-interface
84 first filter
86 second filter
88 first venting unit
90 second venting unit
92 radial first extension
94 first locking member
96 external thread
98 sealing member
100 internal thread
102 radially inwardly facing limb
104 first fastening unit
$d_{a1}$ first outer diameter
$d_{i1}$ first inner diameter
$d_{i2}$ second inner diameter
L longitudinal axis

The invention claimed is:

1. A protective device for a container for receiving substances, the protective device o comprises a flexible casing that surrounds a casing space and comprises a first casing opening; and o has a first tubular member connected to the casing in the region of the first casing opening and having a first container counter-connector unit, a primary first end, and a primary second end, wherein—the first tubular member is connected to the casing such that the primary first end terminates with the first casing opening or projects into the casing space, and—the protective device is connectable to a first container connector unit that surrounds a first container opening of said container and by which the first tubular member is connectable to the container by means of the first container counter-connector unit such that the casing can be introduced into an inner space surrounded by a wall of said container, wherein—a first coupling unit is arranged at the primary second end of the first tubular member to connect a connector member, the first coupling unit being formed in the manner of a first tri-clamp connector.

2. A protective device in accordance with claim 1, wherein the container comprises a second container opening through which the inner space is accessible; and a second container connector unit that surrounds the second container opening and by which a further connector member is connectable to the container; and the flexible casing of the protective device has a second casing opening; and a second tubular member connected to the casing in the region of the second casing opening and having a second container counter-connector unit, a secondary first end, and a secondary second end, wherein the second tubular member is connected to the casing such that the secondary first end terminates with the second casing opening or projects into the casing space; and the protective device is connectable to the second container connector unit by means of the second container counter-connector unit such that the casing can be introduced into the inner space.

3. A protective device in accordance with claim 2, wherein the first container counter-connector unit has a flange-like radial first extension for placing on a first locking member; and/or the second container counter-connector unit has a flange-like radial second extension for placing on a second locking member.

4. A protective device in accordance with claim 3, wherein the first container counter-connector unit is formed in the manner of a first tri-clamp connector; and/or the second container counter-connector unit is formed as a second tri-clamp connector.

5. A protective device in accordance with claim 2, wherein a second coupling unit is arranged at the secondary second end of the second tubular member to connect a connector member.

6. A protective device in accordance with claim 5, wherein the second coupling unit is formed in the manner of a second tri-clamp connector.

7. A protective device in accordance with claim 5, wherein the connector member connected to the first coupling unit is formed in the manner of a first containment interface; and/or the connector member connected to the second coupling unit is formed in the manner of a second containment interface.

8. A protective device in accordance with claim 2, wherein a first fastening unit is arranged between the primary first end and the primary second end of the first tubular member for fastening a connector member to the first tubular member and/or for fastening the first tubular member to the container; and/or a second fastening unit is arranged between the secondary first end and the secondary second end of the second tubular member for fastening a connector member to the second tubular member and/or for fastening the second tubular member to the container.

9. A protective device in accordance with claim 1, wherein the first tubular member and/or the second tubular member is/are produced from a flexible material.

10. A protective device for a container for receiving substances, wherein—the protective device o comprises a flexible casing that surrounds a casing space and comprises a first casing opening and a second casing opening;

has a first tubular member connected to the casing in the region of the first casing opening and having a first container counter-connector unit, a primary first end, and a primary second end, and has a second tubular member connected to the casing in the region of the second casing opening and having a second container counter-connector unit, a secondary first end, and a secondary second end, wherein—the first tubular member is connected to the casing such that the primary first end terminates with the first casing opening or projects into the casing space, the second tubular member is connected to the casing such that the secondary first end terminates with the second casing opening or projects into the casing space; and the protective device is connectable to a first container connector unit that surrounds a first container opening of said container and by which the first tubular member is connectable to the container by means of the first container counter-connector unit such that the casing can be introduced into an inner space surrounded by a wall of the container, and connectable to a second container connector unit that surrounds a second container opening of said container and by which the second tubular member is connectable to the container by means of the second container counter-connector unit such that the casing can be introduced into the inner space surrounded by the wall of the container, and wherein—a first coupling unit is arranged at the primary second end of the first tubular member to connect a connector member, a second coupling unit is arranged at the secondary second end of the second tubular member to connect a connector member, the first coupling unit being formed in the manner of a first tri-clamp connector and the second coupling unit is formed in the manner of a second tri-clamp connector.

* * * * *